US007283773B2

(12) United States Patent
Amano et al.

(10) Patent No.: US 7,283,773 B2
(45) Date of Patent: Oct. 16, 2007

(54) TONER CONTAINER, IMAGE FORMING APPARATUS, AND METHOD FOR IDENTIFYING TONER CONTAINER

(75) Inventors: Takafumi Amano, Kawasaki (JP); Hiroyuki Iizuka, Sunto-gun (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 103 days.

(21) Appl. No.: 11/178,480

(22) Filed: Jul. 12, 2005

(65) Prior Publication Data

US 2006/0008299 A1 Jan. 12, 2006

(30) Foreign Application Priority Data

Jul. 12, 2004 (JP) ..... 2004-205100

(51) Int. Cl.
*G03G 15/08* (2006.01)

(52) U.S. Cl. ..... 399/262; 399/12; 399/27; 399/88; 399/120; 399/258

(58) Field of Classification Search ..... 399/262, 399/263, 260, 258, 256, 119, 120, 88, 12, 399/27; 222/DIG. 1; 430/120, 120.1
See application file for complete search history.

(56) References Cited

U.S. PATENT DOCUMENTS 6,256,469 B1 * 7/2001 Taniyama et al. ..... 399/258
6,266,505 B1 * 7/2001 Ban et al. ..... 399/258
6,343,883 B1 * 2/2002 Tada et al. ..... 399/12 X
2004/0131389 A1 * 7/2004 Tazawa et al. ..... 399/258
2005/0135842 A1 * 6/2005 Murakami et al. ..... 399/262
2006/0013621 A1 1/2006 Kimura et al.

FOREIGN PATENT DOCUMENTS

JP 2002-174946 A 6/2002

* cited by examiner

*Primary Examiner*—Sophia S. Chen
(74) *Attorney, Agent, or Firm*—Foley & Lardner LLP

(57) ABSTRACT

A toner container installed in an image forming apparatus, the toner container including a toner container main body having a predetermined length and which accommodates toner, a mixer which stirs the toner in the toner container main body, a discharge port through which the toner in the toner container main body is discharged from the toner container main body, a screw having one end projected from one end surface of the toner container main body, the screw being rotated to convey the toner from the toner container main body to the discharge port, a coupling portion provided at the one end of the screw and rotated by a driving portion provided in the image forming apparatus, and a protruding portion provided on an outer peripheral surface of the coupling portion.

21 Claims, 7 Drawing Sheets

TONER CONTAINER, IMAGE FORMING APPARATUS, AND METHOD FOR IDENTIFYING TONER CONTAINER

CROSS-REFERENCE TO RELATED APPLICATIONS

This application is based upon and claims the benefit of priority from prior Japanese Patent Application No. 2004-205100, filed Jul. 12, 2004, the entire contents of which are incorporated herein by reference.

BACKGROUND OF THE INVENTION

1. Field of the Invention

The present invention relates to a toner container used to supply toner to an image forming apparatus main body, as well as a related image forming apparatus and a method for identifying a toner container.

2. Description of the Related Art

Image forming apparatuses have a toner cartridge used to supply toner to a developing device. The toner cartridge is detachably installed in the image forming apparatus so that a user can easily replace the toner cartridge when the toner in the toner cartridge is exhausted.

Copier makers recommend several toner cartridges for use with its manufactured copiers in order to manage the products and to maintain printing quality. This is because the use of an inferior toner cartridge may degrade printing quality, and in some cases, cause a failure in the copier.

Further, the user cannot always recognize that a failure results from the use of an inferior toner cartridge. Thus, copier makers recommend toner cartridges that can maintain printing quality with their copiers in order to prevent failures in the copiers or related accidents.

Thus, since some toner cartridges may lead to a failure in the copier or a related accident, it may be necessary to determine the type of the toner cartridge in the copier. Further, the user may mistakenly use a toner cartridge that should not intrinsically be used, for example, a toner cartridge for different colors, though it has a sufficient quality.

Thus, techniques for determining the type of a toner cartridge have been commonly used (see, for example, Jpn. Pat. Appln. KOKAI Publication No. 2002-174946).

However, the technique described in Jpn. Pat. Appln. KOKAI Publication No. 2002-174946 is applicable to rotatable bottle-type toner containers but not to those which are not shaped like bottles.

Moreover, toner cartridges are expendable supplies and are thus involved in severe price competition; it is often difficult to provide them with added values. For example, providing the toner cartridge with a toner remaining amount sensor enables the precise determination of the amount of toner remaining in the toner cartridge. This makes it possible to allow the copier to display a message urging the user to replace the toner cartridge with a new one according to the sensed amount.

However, not all the toner cartridges have a toner remaining amount sensor for the above cost reason.

BRIEF SUMMARY OF THE INVENTION

To solve the above problem, it is an object of the present invention to provide a non-rotatable non-bottle-shaped toner container which enables the prevention of a failure or accident resulting from an incorrect installation, as well as a related image forming apparatus and a method for identifying a toner container.

It is another object of the present invention to provide a toner container and an image forming apparatus which enable a toner remaining amount to be detected without increasing costs.

To solve the above problem and to accomplish these objects, the toner container, image forming apparatus, and method for identifying a toner container according to the present invention are configured as described below.

(1) A toner container installed in an image forming apparatus, the toner container comprising a toner container main body having a predetermined length and which accommodates toner, a mixer which stirs the toner in the toner container main body, a discharge port through which the toner in the toner container main body is discharged from the toner container main body, a screw having one end projected from one end surface of the toner container main body, the screw being rotated to convey the toner from the toner container main body to the discharge port, a coupling portion provided at the one end of the screw and rotated by a driving portion provided in the image forming apparatus, and a protruding portion provided on an outer peripheral surface of the coupling portion.

(2) An image forming apparatus comprising a toner container and an image forming apparatus main body in which the toner container is installed, the toner container comprising a toner container main body having a predetermined length and which accommodates toner, a mixer which stirs the toner in the toner container main body, a discharge port through which the toner in the toner container main body is discharged from the toner container main body, a screw having one end projected from one end surface of the toner container main body, the screw being rotated to convey the toner from the toner container main body to the discharge port, a coupling portion provided at the one end of the screw and which rotates with the screw, and a protruding portion provided on an outer peripheral surface of the coupling portion, the image forming apparatus main body comprising a driving portion which rotates the screw, a pushed portion which is pushed by the protruding portion rotating with the screw, a detecting portion which detects that the protruding portion is pushing the pushed portion, and a determining portion which determines the type of the toner container on the basis of the detection by the detecting portion.

(3) A toner container installed in an image forming apparatus, the toner container comprising a toner container main body having a predetermined length and which accommodates toner, a mixer which stirs the toner in the toner container main body, a discharge port through which the toner in the toner container main body is discharged from the toner container main body, a screw having one end projected from one end surface of the toner container main body, the screw being rotated to convey the toner from the toner container main body to the discharge port, a coupling portion provided at the one end of the screw and rotated by a driving portion provided in the image forming apparatus, a protruding portion provided on an outer peripheral surface of the coupling portion and rotated to push a pushed portion provided in the image forming apparatus, and a storage portion which stores the number of times the pushed portion has been pushed.

(4) A method for identifying a toner container installed in an image forming apparatus, the method comprising a step of rotating a protruding portion provided on the toner container to push a pushed portion provided in the image forming apparatus, a step of detecting that the projecting portion is pushing the pushed portion, and a step of determining the type of the toner container on the basis of the detection of the pushing of the pushed portion.

The present invention provides a non-rotatable non-bottle type toner container which enables the prevention of a failure or accident resulting from an incorrect installation.

The present invention enables the toner remaining amount to be enabled without increasing costs.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

Description will be given of embodiments for carrying out the present invention.

Figure 1:
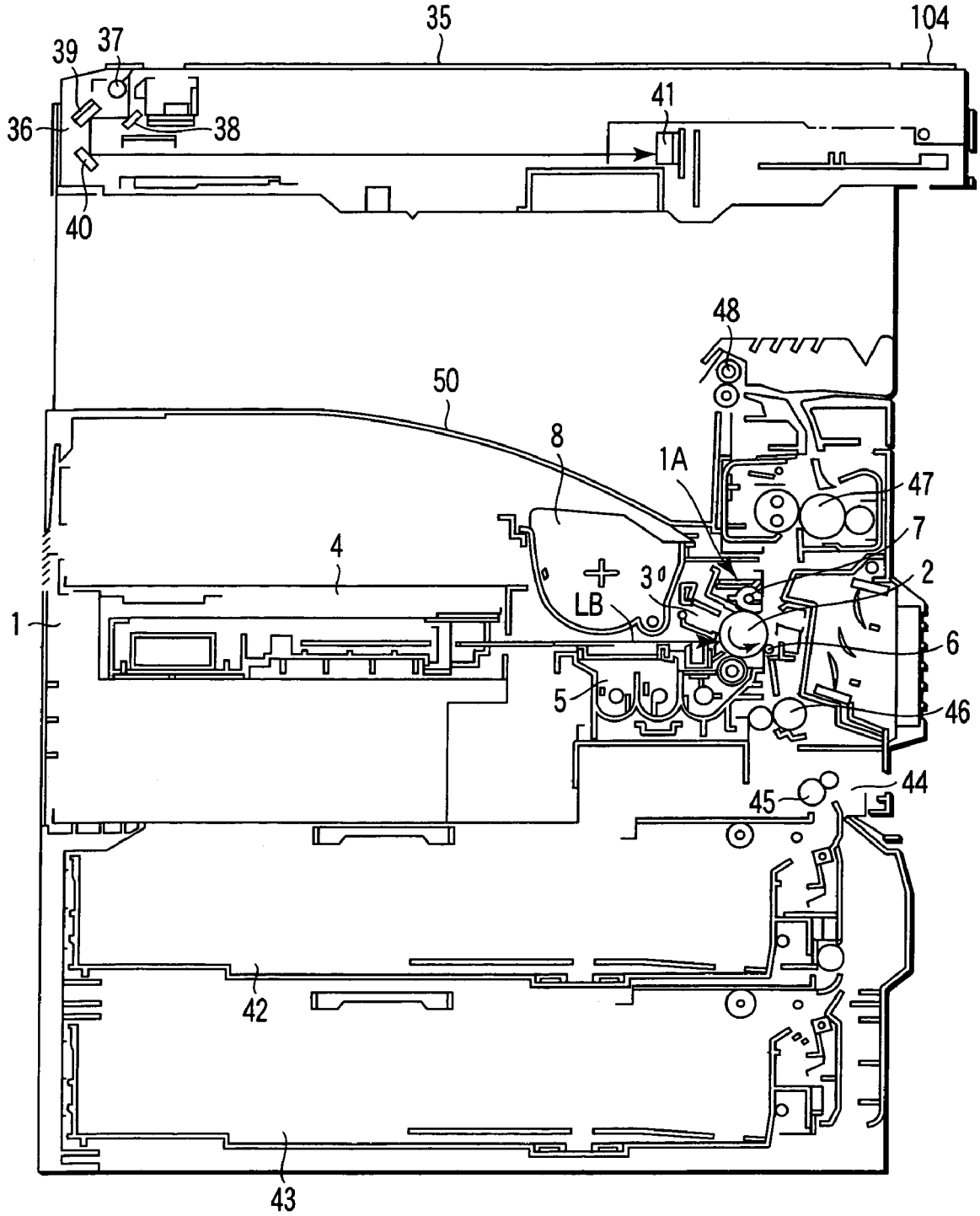
FIG. 1 is a schematic diagram showing the internal structure of an electrophotographic copier according to an embodiment of the present invention.

With reference to FIG. 1, description will be given of the internal structure of an electrophoto-graphic copier according to an embodiment of the present invention.

FIG. 1 is a schematic diagram showing the internal structure of the electrophotographic copier according to the embodiment of the present invention.

As shown in FIG. 1, the electrophotographic copier has a copier main body (image forming apparatus) 1 and an image forming portion 1A provided on one side of the center of the copier main body 1. The image forming portion 1A comprises a photosensitive drum 2 that is rotatable in the direction of an arrow in the figure. The following are sequentially disposed around the photosensitive drum 2 along a direction in which the photosensitive drum 2 rotates: a charger 3 that charges the surface of the photosensitive drum 2, a laser unit 4 that forms an electrostatic latent image on the surface of the photosensitive drum 2, a developing device 5 that develops the electrostatic latent image on the photosensitive drum 2 using toner, a transfer roller 6 that transfers a toner image on the photosensitive drum 2 to a sheet, and a cleaning device 7 that removes residual toner on the photosensitive drum 2.

The developing device 5 houses a two-component developer consisting of a carrier and toner. A toner cartridge 8 (toner container) is disposed above the developing device 5 to supply toner to the developing device 5. The toner cartridge 8 is replaced by a user and inserted and installed in a housing portion (not shown) in the copier main body 1 from the vicinity of a first coupling member (described later) 12.

A copy board 35 is provided on the top surface of the copier main body 1. A scanner 36 is provided below the copy board 35 to expose a document on the copy board 35. The scanner 36 comprises a light source 37 that irradiates the document with light, a first reflecting mirror 38 that reflects light reflected by the document, in a predetermined direction, a second and third reflecting mirrors 39 and 40 that sequentially reflect the light reflected by the first reflecting mirror 38, and a light receiving element 41 that receives the light reflected by the third reflecting mirror 40.

A plurality of sheet feeding cassettes 42 and 43 are provided at the bottom of the copier main body 1. Sheets in the sheet feeding cassettes 42 and 43 are conveyed upward via a conveying system 44. The conveying system 44 is provided with a conveying roller pair 45, a registration roller pair 46, an image transfer portion, a fixing roller pair 47, and a sheet discharging roller pair 48.

During image formation, the light source 37 irradiates a document on the copy board 35 with light. The light is reflected by the document and received by the light receiving element 41 via the first to third reflecting mirrors 38 to 40 to read a document image. On the basis of this read information, the laser unit 4 irradiates the surface of the photosensitive drum 2 with laser light LB. The surface of the photosensitive drum 2 is charged by the charger 3 to a negative polarity. The laser unit 4 irradiates the photosensitive drum 2 with laser light LB to expose the photosensitive drum 2.

This causes the surface potential of the photosensitive drum 2 to become closer to zero in an area corresponding to the image part of the document, depending on the density of the image. Rotation of the photosensitive drum 2 locates the electrostatic latent image opposite to the developing device 5. In this position, the electrostatic latent image attracts toner supplied by the carrier to become a visible image.

A sheet from the sheet feeding cassette 42 or 43 has been conveyed through the conveying system 44 and fed into the image transfer portion between the transfer roller 6 and the photosensitive drum 2. Thus, the visible image on the photosensitive drum 2 is transferred to the sheet charged to a positive polarity.

The sheet to which the image has been transferred is conveyed to the fixing roller pair 47. The sheet is then heated and pushed to fix the image to the sheet. Once the image is fixed, the sheet is discharged onto a sheet discharging tray 50 by the sheet discharging roller pair 48.

On the other hand, some of the toner remains on the surface of the photosensitive drum 2 without being transferred in the image transfer portion to the sheet. This residual toner is removed by the cleaning device 7 and then returned to the developing device 5 by the recovery mechanism (not shown) for reuse. Further, when the toner in the developing device 5 is consumed, the toner cartridge 8 supplies toner to the developing device 5.

Now, the configuration of the toner cartridge 8 will be described with reference to FIGS. 2 and 3.

Figure 2:
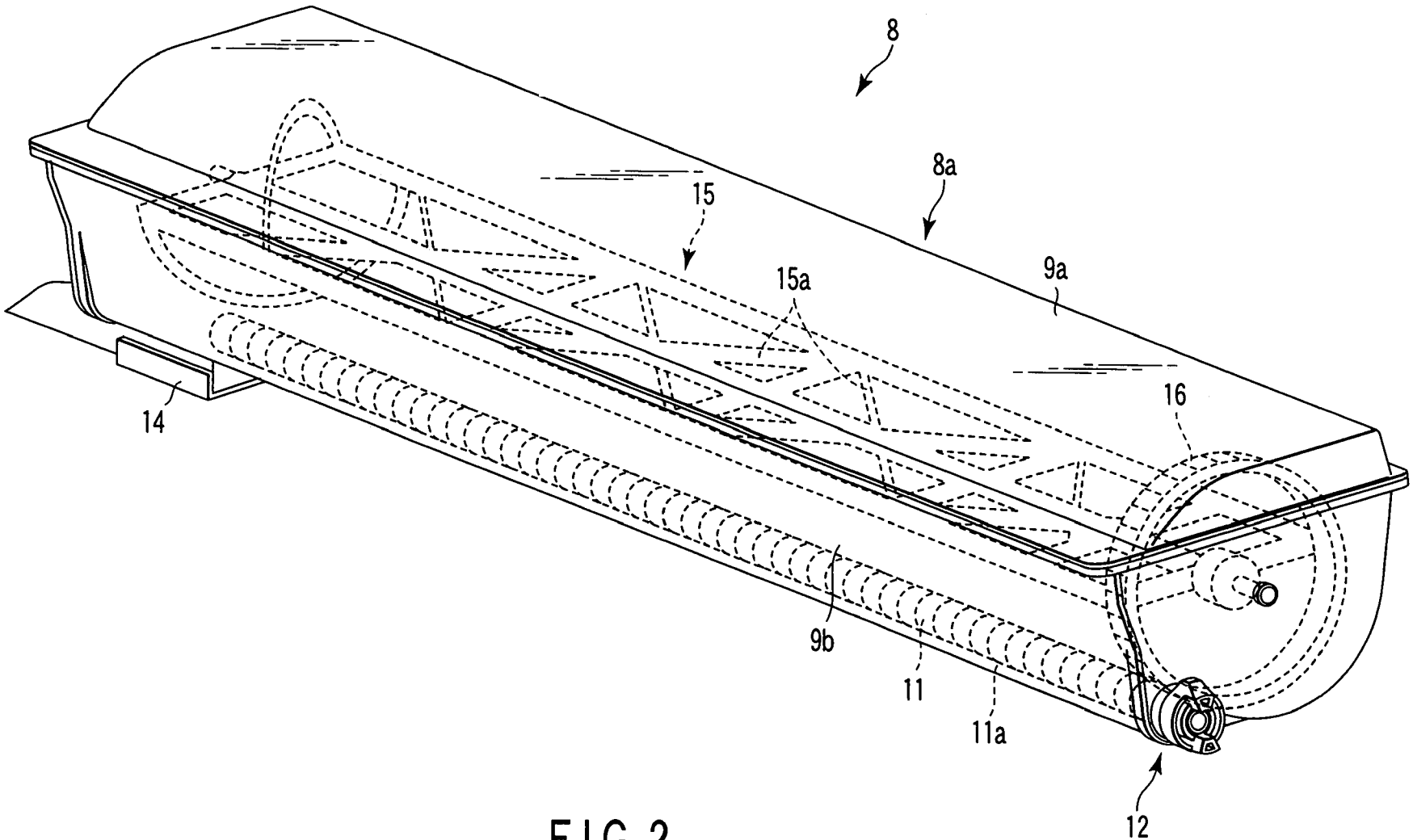
FIG. 2 is a perspective view of a toner cartridge according to the embodiment.

FIG. 2 is a perspective view of the toner cartridge 8 according to the embodiment. FIG. 3 is a plan view showing the internal configuration of the toner cartridge 8 according to the embodiment.

Figure 3:
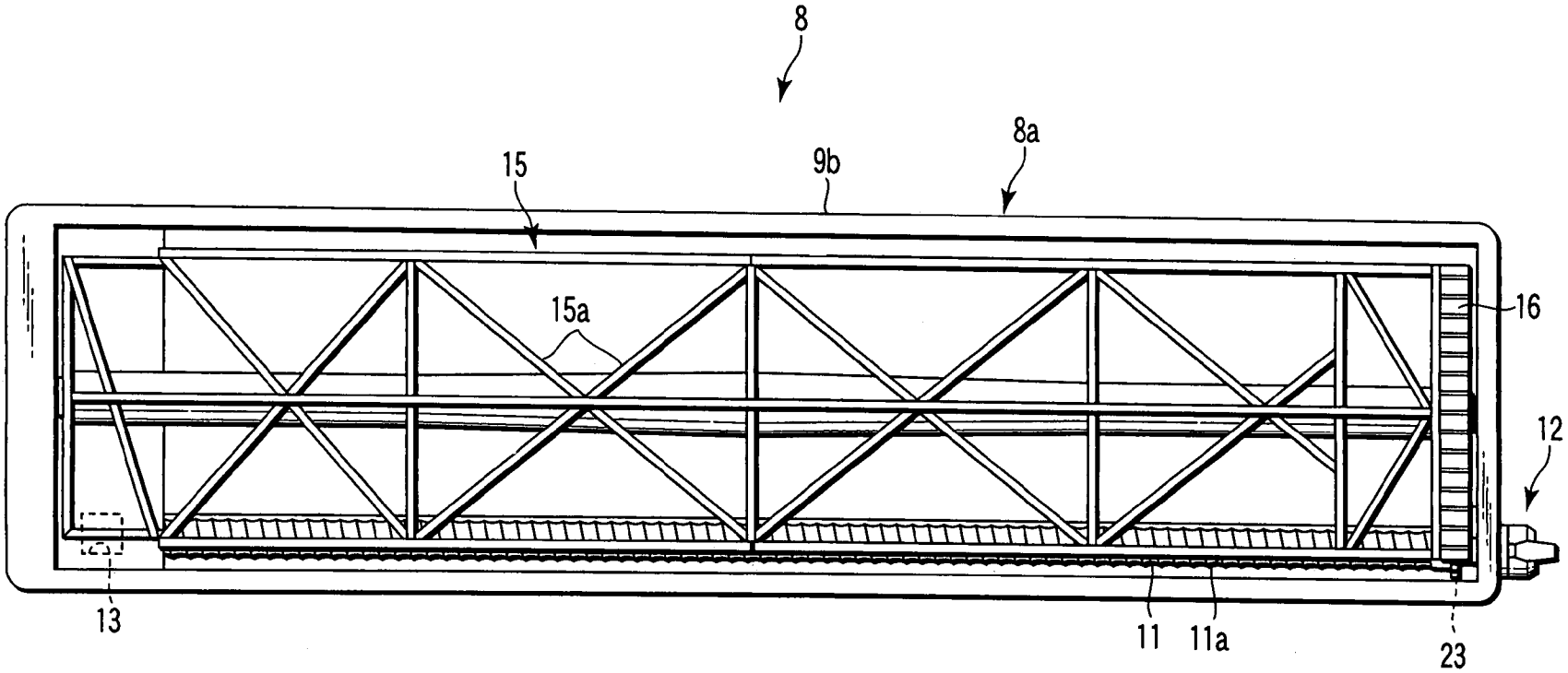
FIG. 3 is a plan view showing the internal configuration of the toner cartridge according to the embodiment.

As shown in FIGS. 2 and 3, the toner cartridge 8 has a long toner cartridge 8*a* (toner container main body) in which toner is accommodated. The toner cartridge main body 8*a* is composed of an upper case 9*a* and a lower case 9*b* which can be separated from each other in a vertical direction. A bar-like screw 11 is provided at the inner bottom of the lower case 9*b* along a longitudinal direction to convey toner to a discharge port (described later) 13.

The screw 11 is rotatably supported at its opposite ends by the opposite longitudinal end surfaces of the lower case 9*b*. A plurality of spiral blade portions 11*a* are formed on the outer peripheral surface of the screw 11. One end of the screw 11 projects outward from one of the end surfaces of the lower case 9*b*. A first coupling member (coupling portion) 12 is provided at the tip of this end of the screw; the first coupling member 12 is connected to a driving device (described later) 30 in the copier main body 11. The first coupling member 12 is an important point of the present invention and will be described later in detail.

Further, the discharge port 13 (shown only in FIG. 3) is formed at the bottom of the lower case 9*b* and opposite to the other end of the screw 11 to discharge toner in the toner cartridge main body 8*a* to the developing device 5. A shutter 14 (shown only in FIG. 2) is provided at the lower end of the discharge port 13. When the toner cartridge 8 is inserted and installed in the housing portion of the copier main body 1, the shutter 14 is opened to enable the toner in the toner cartridge main body 8*a* to be discharged to the developing device 5.

A mixer 15 is provided inside the toner cartridge main body 8*a* along the longitudinal direction to stir the toner in the toner cartridge main body 8*a*.

The mixer 15 has a plate-like truss structure consisting of a combination of thin bar-like members 15*a*. The opposite ends of the mixer 15 are rotatably supported by the opposite longitudinal end surfaces of the lower case 9*b*.

A mixer gear 16 is provided at one of the longitudinal ends of the mixer 15. The mixer gear 16 interlocks with a screw gear 23 (shown only in FIG. 3) provided at this longitudinal end of the screw 11. Rotation of the screw 11 rotates the mixer 15 in unison.

Now, with reference to FIGS. 4 to 6, a detailed description will be given of the configuration of the first coupling member 12, which is an important point of the present invention.

Figure 4:
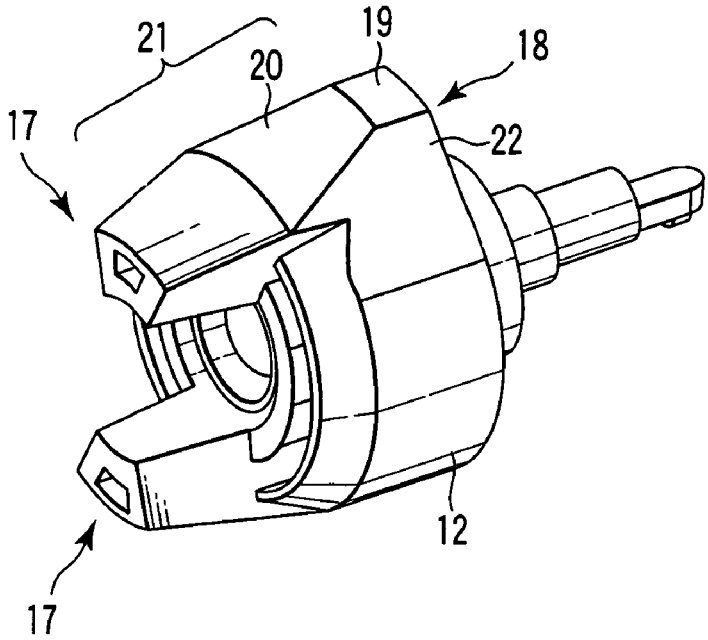
FIG. 4 is a perspective view of a first coupling member according to the embodiment.

FIG. 4 is a perspective view of the first coupling member 12 according to the embodiment. FIG. 5 is a front view of the first coupling member 12 according to the embodiment. FIG. 6 is a side view of the first coupling member 12 according to the embodiment.

Figure 5:
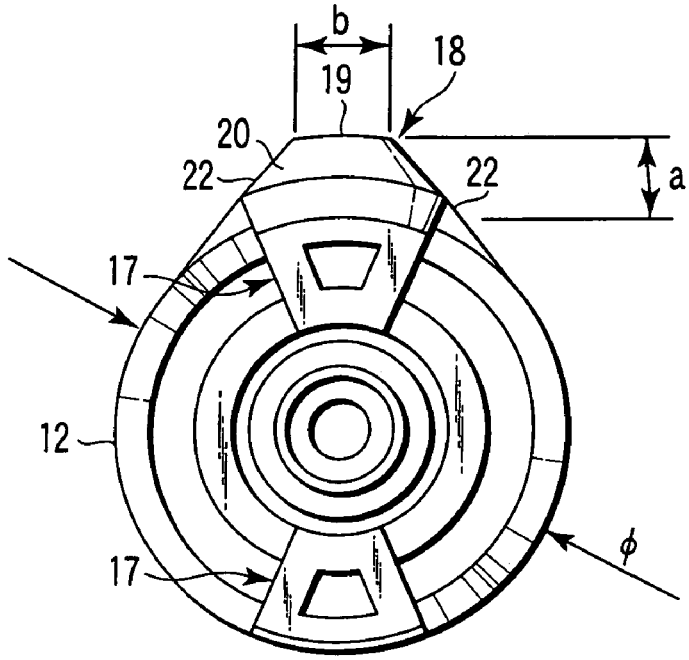
FIG. 5 is a front view of the first coupling member according to the embodiment.
Figure 6:
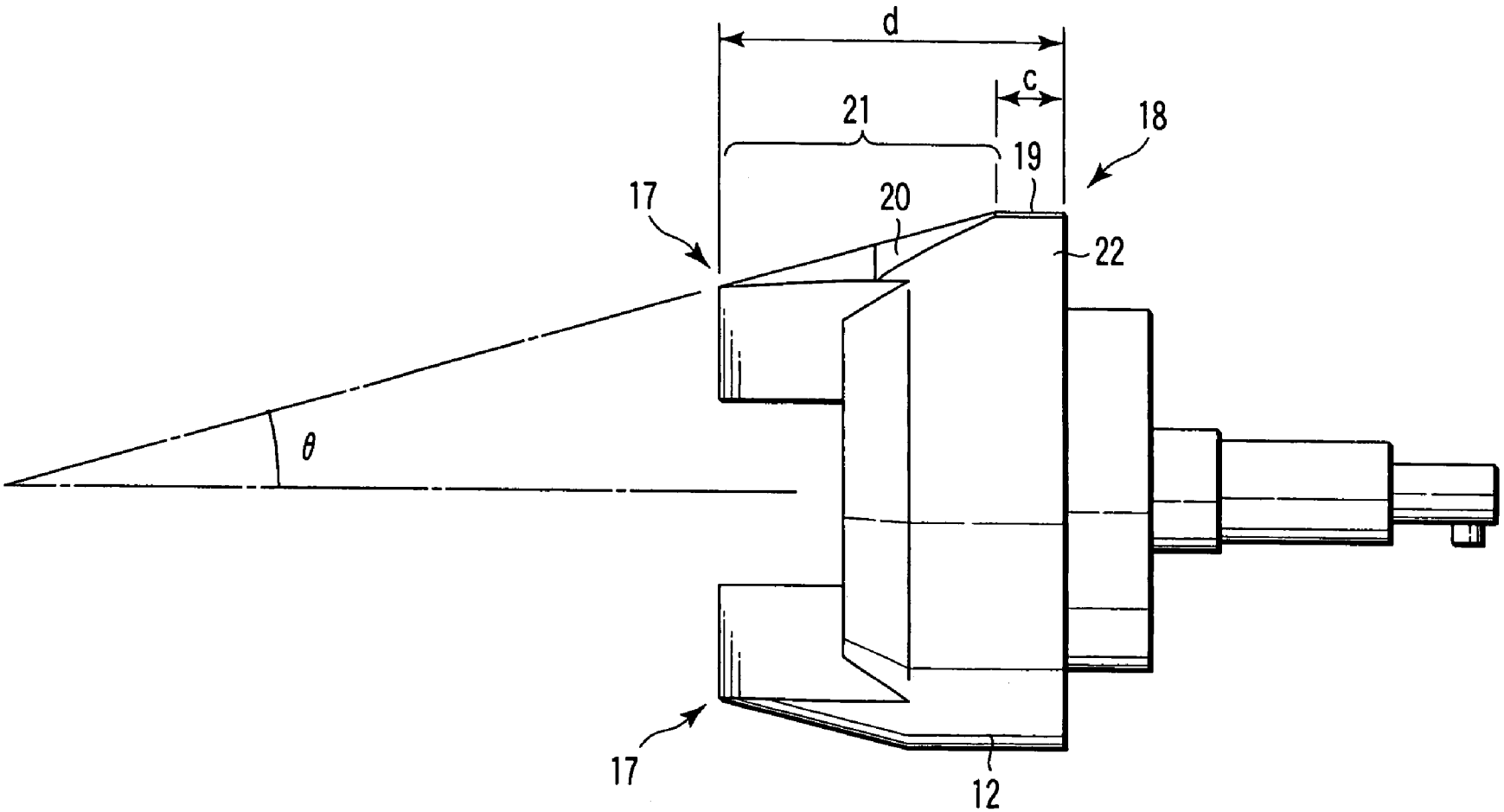
FIG. 6 is a side view of the first coupling member according to the embodiment.

As shown in FIGS. 4 to 6, the first coupling member 12 is formed like a flat cylinder. A radially central portion of the first coupling member 12 is fixed to the tip of the screw 11. The outer diameter Ø of the first coupling member 12 is set at about 10 to 30 mm.

Projecting portions 17 are provided on an end surface of the first coupling member 12 which is opposite from the toner cartridge main body 8*a* and at positions separated from each other by 180° in a circumferential direction of the first coupling member 12. The projecting portions 17 engage with the driving device (described later) 30, provided in the copier main body 1.

Of the surfaces constituting each of the projecting portions 17, a surface (referred to as an "outer surface" below) located radially outside the first coupling member 12 has an axis common to the first coupling member 12. The outer surface is composed of a part of a conical surface that is narrowed as the distance from the toner cartridge main body 8*a* increases.

In other words, the outer surface of the projecting portion 17 forms an inclined surface that approaches the axis of the first coupling member 12 as the distance from the first coupling member 12 increases. The angle of inclination θ of the outer surface of the projecting portion 17 is preferably 5° to 30° when measured from the axis of the first coupling member 12.

A protruding portion 18 is provided on the outer peripheral surface of the first coupling member 12 and at a position corresponding to one of the projecting portions 17 in the circumferential direction of the first coupling member 12. The protruding portion 18 is used to push a push button (described later) 62 in the copier main body 1.

Of the surfaces constituting the protruding portion 18, a surface (referred to as an "outer surface" below) located radially outside the first coupling member 12 is composed of a pushing surface 19 that pushes the push button 62 and an installing connecting surface 20 that connects the outer surface of the projecting portion 17 and the pushing surface 19 together.

The pushing surface 19 is composed of a part of a cylindrical surface having an axis common to the first coupling member 12. On the other hand, the installing connecting surface 20 is composed of a part of the conical surface as that constituting the outer surface of the projecting portion 17. That is, the installing connecting surface 20 is connected smoothly to the outer surface of the projecting surface 17 without any steps. The installing connecting surface 20 constitutes, together with the outer surface of the projecting portion 17, a installing guide surface 21 used to guide the push button 62.

The angle of inclination θ is set at 5° to 30° because at an angle of inclination θ of at least 30°, the first coupling member 12 has an excessively large outer diameter so that the projecting portion 17 or protruding portion 18 may be broken upon installation in the toner cartridge main body 8*a*, whereas at an inclination θ of at most 5°, the detecting function of the protruding portion 18, described later, may not be provided sufficiently.

The height (a) of the protruding portion [to be precise, the height of the pushing surface 19] with respect to the radial direction of the first coupling member 12 is 2 to 10 mm when measured from the outer peripheral surface of the first coupling member 12. The length (b) of the pushing surface 19 with respect to the circumferential direction of the first coupling member 12 is 4 to 15 mm when measured from the outer peripheral surface of the first coupling member 12.

Further, the length (c) of the pushing surface 19 with respect to the axial direction of the first coupling member 12 is 1 to 5 mm. The sum of the lengths (d) of the projecting portion 17 and protruding portion 18 with respect to the axial direction of the first coupling member 12 is 10 to 30 mm.

Parts of the outer surface of the protruding portion 18 and the outer peripheral surface of the first coupling member 12 are connected together with pushing connecting surfaces 22 formed along the contact plane of the outer peripheral surface of the first coupling member 12; the parts of the outer surface are located on the circumferentially opposite sides of the first coupling member 12.

Now, with reference to FIG. 7, description will be given of the relationship between the first coupling member 12 and the push switch 60.

Figure 7:
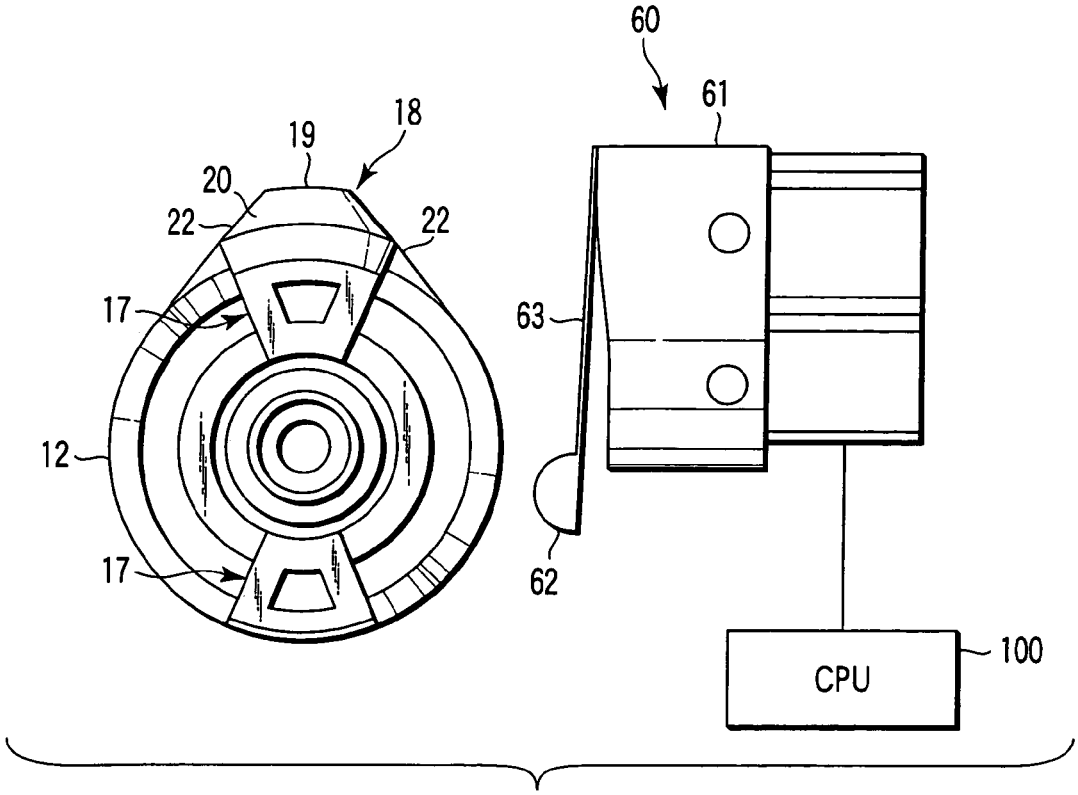
FIG. 7 is a schematic diagram showing the relationship between the first coupling member and a push switch according to the embodiment.

FIG. 7 is a schematic diagram showing the relationship between the first coupling member 12 and the push switch 60 according to the embodiment.

As shown in FIG. 7, a push switch 60 that detects the protruding portion 18 of the first coupling member 12 is provided at a position such that it lies opposite to the outer peripheral surface of the first coupling member 12 when the toner cartridge 8 is inserted and installed in the housing portion of the copier main body 1.

The push switch 60 comprises a switch main body 61 having the substantially semispherical push button (pushed portion) 62 provided on its side closer to the first coupling member 12 via a plate like resilient member 63. The resilient member 63 is, for example, a metal plate, a resin plate, or a leaf spring.

When not pushed, the push button 62 is located at a distance which is larger than the radius Ø/2 of the first coupling member 12 and which is smaller than a distance (Ø/2+a) equal to the radius Ø/2 plus the height (a) of the protruding portion 18, from the axis of the first coupling member 12.

Thus, as the first coupling member 12 is rotated, the push button 62 is pushed only when the protruding portion 18 lies opposite to the push button 62. Otherwise the push button 62 is not pushed.

As the push button 62 runs onto the pushing surface 19 of the protruding portion 18 perfectly, the switch main body 61 detects the presence of the protruding portion 18 and is thus turned on. The switch main body 61 then outputs an electric signal to a CPU 100 serving as a control device.

On the basis of the electric signal from the switch main body 61, t he CPU 100 (determining portion, detecting portion) detects the time for which the switch has been on, that is, the time for which the push button 62 has remained on the pushing surface 19 of the protruding portion 18, the number of times that the switch was turned on during a predetermined time, that is, the number of times the screw 11 rotated during the predetermined time. In addition to the detection of the above ON state, the CPU 100 performs the control of each section of the electrophotographic copier including the control of the rotation speed of a second coupling member 31 (described later).

Now, with reference to FIG. 8, description will be given of the relationship between the first coupling member 12 and the second coupling member 31.

Figure 8:
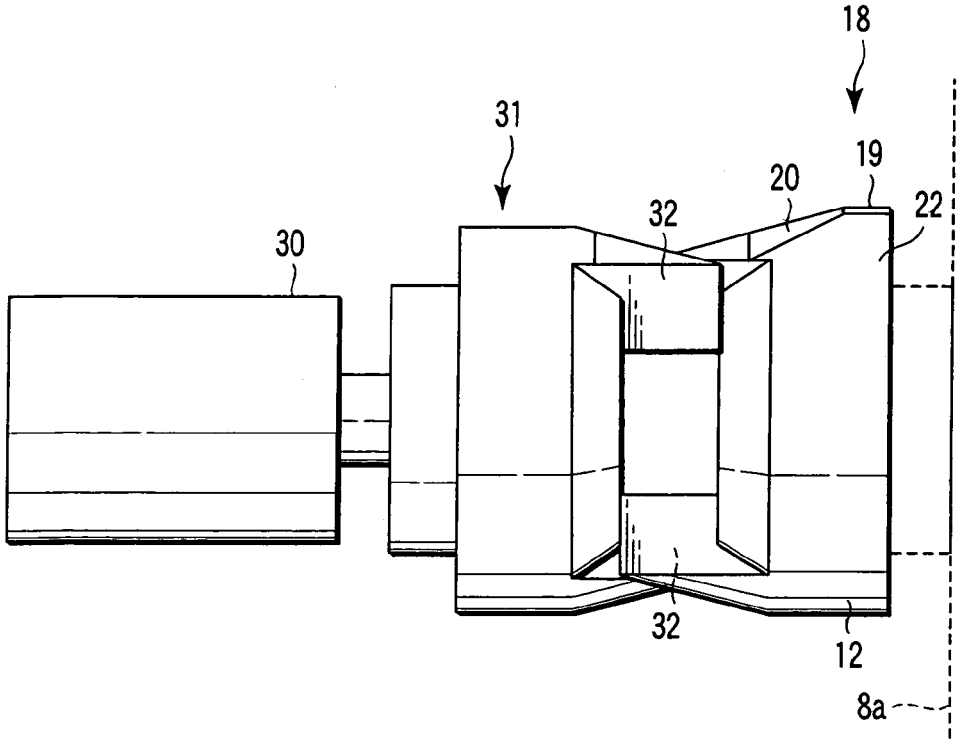
FIG. 8 is a schematic diagram showing the relationship between the first coupling member and a second coupling member according to the embodiment.

FIG. 8 is a schematic diagram showing the relationship between the first coupling member 12 and the second coupling member 31 according to the embodiment.

As shown in FIG. 8, the driving device 30 (driving portion) that rotates the screw 11 is provided at a position such that it sits close to the first coupling member 12 when the toner cartridge 8 is inserted and installed in the housing portion of the copier main body 1.

The driving device 30 comprises the second coupling member 31 located opposite to the first coupling member 12 and having substantially the same shape as that of the first coupling member 12. The first coupling member 12 comprises the protruding portion 18, whereas the second coupling member 31 does not comprises the protruding portion 18.

Projecting portions 32 of the second coupling member 31 engage with the projecting portions 17 of the first coupling member 12. Driving the driving device 30 enables the second coupling member 31 to rotate the first coupling member 12 at a predetermined speed.

Figure 9:
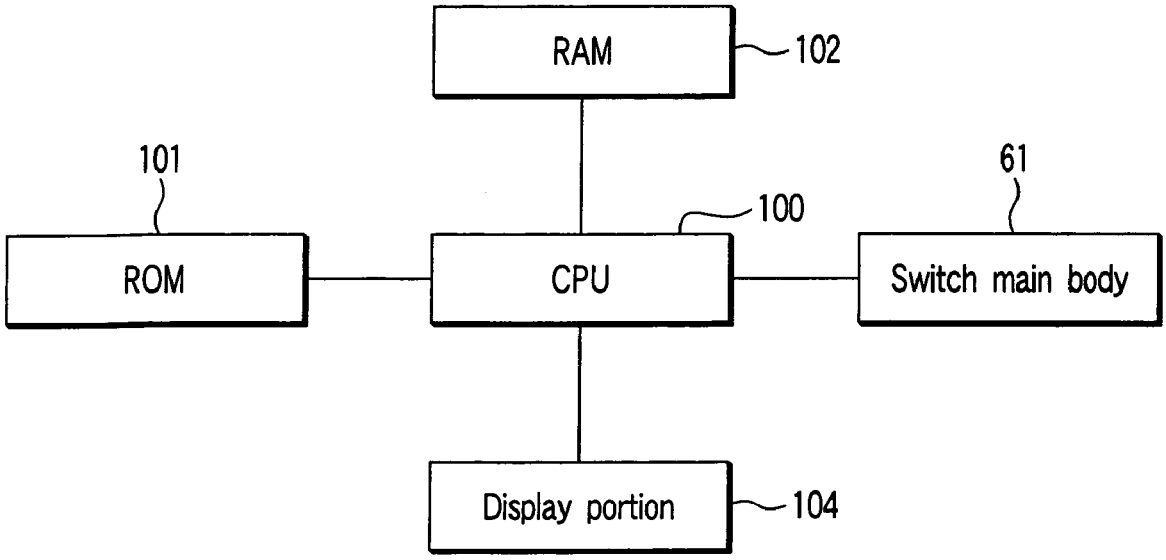
FIG. 9 is a block diagram of control in a copier main body according to the embodiment.

FIG. 9 is a block diagram of control in the copier main body 1 according to the embodiment.

As shown in FIG. 9, the CPU 100 is connected to a ROM 101, a RAM (storage portion) 102, the switch main body 61, and a display section 104.

The ROM 101 stores a specified time used as a reference for determination of the type of the toner cartridge 8 and a specified number used as a reference for determination of the time to replace the toner cartridge 8.

The specified time is the time for which the switch main body 61 has remained turned on if the toner cartridge 8 according to the present embodiment is installed. The specified time is determined on the basis of the rotation speed of the first coupling member 12 and the length (b) of the pushing surface 19 in the circumferential direction of the first coupling member 12. Detection of the duration of the ON state is equivalent to detection of the length (b) of the pushing surface 19 in the circumferential direction of the first coupling member 12.

On the other hand, the specified number is the total number of rotations of the screw 11 made after a new toner cartridge 8 is installed and before the amount of toner remaining reaches zero. The specified number is determined on the basis of the amount of toner in the toner cartridge main body 8*a*.

On the basis of the electric signal from the switch main body 61, the CPU 100 detects the duration of the ON state, that is, the time for which the push button 62 has remained on the pushing surface 19 of the protruding portion 18, and the number of times that the switch was turned on during a predetermined time, that is, the number of times the screw 11 rotated during the predetermined time.

Further, the CPU 100 determines whether or not the duration of the ON state is within a predetermined error range from the specified time stored in the ROM 101. On the basis of the determination, the machine determines the type of the toner cartridge 8.

Moreover, the CPU 100 stores in the ROM 102 the number of times the switch was turned on during the predetermined time. The CPU 100 then compares the total number of times with the specified number stored in the ROM 101. Then, on the basis of the comparison, the CPU 100 predicts the amount of toner remaining in the toner cartridge main body 8*a*.

In addition to the detection of the above ON state, the CPU 100 performs the control of each section of the electrophotographic copier. The control includes, for example, the control of the rotation speed of the second coupling member 31 (described later).

The display section 104 displays various messages according to the determination by the CPU 100.

Now, description will be given of an operation of determining the type of the installed toner cartridge 8.

If the toner cartridge 8 is installed in the copier main body 1, it is inserted into the housing portion of the copier main body 1 from the vicinity of the first coupling member 12. The first coupling member 12 and the second coupling member 31 are then engaged with each other.

Once the toner cartridge 8 is installed in the copier main body 1, the driving device 30 rotates the second coupling member 31 at a predetermined speed. This rotates the first coupling member 12, engaged with the second coupling member 31, at the predetermined speed.

Rotation of the first coupling member 12 moves the protruding portion 18 closer to the push button 62; the protruding portion 18 is provided on the outer peripheral surface of the first coupling member 12. Finally, the push button 62 slides along the pushing connecting surface 22 and runs onto the pushing surface 19 of the protruding portion 18.

Once the push button 62 runs onto the pushing surface 19 of the protruding portion 18, the switch main body 61 is turned on and outputs an electric signal to the CPU 100. The CPU 100 receives the electric signal, then detects the duration of the ON state, that is, the time for which the push button 62 has remained on the pushing surface 19 of the protruding portion 18.

The CPU 100 then compares the duration of the ON state with the specified time stored in the ROM 101. The CPU 100 thus determines whether or not the duration of the ON state is within the predetermined error range from the specified time.

On the basis of the determination, the machine determines the type of the toner cartridge 8. Further, on the basis of this determination, the display section 104 shows a message such as "Not recommended toner cartridge. Are you sure this toner cartridge will be installed?"

Further, on the basis of the electric signal from the switch main body 61, the CPU 100 detects the number of times the push button 62 ran onto the pushing surface 19 during the predetermined time, that is, the number of times the screw 11 rotated during the predetermined time.

A counter provided in the CPU 100 counts the number of times the screw 11 rotated during the predetermined time. The CPU 100 adds up the number of times together and calculates the total rotation number of the screw 11. The total rotation number of the screw 11 is stored in the RAM 102, and compared with a specified number of rotations by the CPU 100 for each predetermined time. On the basis of the comparison, the amount of toner remaining in the toner cartridge main body 8*a* is predicted. When the predicted amount of toner remaining in the toner cartridge main body 8*a* becomes close to zero, the display section 104 displays a sign that instructs the user to replace the toner cartridge 8.

In the present embodiment, the total rotation number of the screw 11 is stored in the ROM 101. However, the present invention is not limited to this. For example, a storage portion such as an IC chip may be attached to the toner cartridge 8 so that the total rotation number of the screw 11 can be stored in the storage portion.

For a certain reason, the toner cartridge 8 may be temporarily removed from the copier main body 1 and another toner cartridge may be installed instead. In this case, even if the original toner cartridge 8 is installed back in the copier main body 1, the toner remaining amount can be precisely predicted. This is because the total rotation number of the screw 11 is stored in the storage portion of the toner cartridge 8. That is, the total rotation number of the screw 11 is stored for each toner cartridge, the toner remaining amount can be precisely predicted for each toner cartridge.

According to the toner cartridge 8 configured as described above, the protruding portion 18 is provided on the outer peripheral surface of the first coupling member 12. Rotation of the first coupling member 12 causes the push button 62 to run onto the pushing surface 19 of the protruding portion 18.

Thus, the type of the installed toner cartridge 8 can be determined by detecting the time for which the push button 62 has remained on the pushing surface 19 and comparing this time with the specified time stored in the ROM 101. As a result, it is possible to prevent degradation of image quality and a defect in the electrophotographic copier.

The protruding portion 18 is provided at the position corresponding to the projecting portion 17 in the circumferential direction of the first coupling member 12. The outer surface of the projecting portion 17 and the installing connecting surface 20 of the protruding portion 18 form the installing guide surface 21, along which the push button 62 is guided to the pushing surface 19 during installation of the toner cartridge 8.

Thus, when the toner cartridge 8 is installed in the copier main body 1, the protruding portion 18 is not readily caught on the push button 62 even if it lies opposite to the push button 62.

Therefore, the user can insert and install the toner cartridge 8 in the housing portion of the copier main body 1 without the need to take into account the position of the protruding portion 18, that is, the angle of the first coupling member 12. This makes it possible to reduce working burdens associated with the replacement of the toner cartridge 8.

Further, the protruding portion 18 is provided at the position corresponding to the projecting portion 17 in the circumferential direction of the first coupling member 12. The outer surface of the projecting portion 17 and a part of the outer surface of the protruding portion 18 form the installing guide surface 21, along which the push button 62 is guided.

Thus, the angle of inclination of the installing guide surface is smaller than that used if the installing guide surface is formed utilizing only a part of the outer surface of the protruding portion 18. This reduces the frictional force acting on the push button 62 when it slides along the installing guide surface 21. Consequently, the toner cartridge 8 can be smoothly installed.

According to the electrophotographic copier configured as described above, the number of times the screw 11 has rotated since the installation of the toner cartridge 8 is calculated on the basis of the number of times the push button 62 has run onto the pushing surface 19 of the protruding portion 18. Then, on the basis of this calculation, the amount of toner remaining in the toner cartridge main body 8*a* is predicted. When the toner remaining amount becomes close to zero, the display section 104 displays the sign that instructs the user to replace the toner cartridge 8.

Thus, the user can replace the toner cartridge 8 before the density of printing on the sheet decreases. This makes it possible to prevent wasteful printing at a reduced density.

Now, description will be given of a variation of the electrophotographic copier in which the toner cartridge 8 according to the present invention is mounted.

In the present embodiment, the CPU 100 controls the rotation speed of the second coupling member 31. However, by detecting the number of times the push button 62 ran onto the pushing surface 19 during the predetermined time, it is possible to more precisely detect the rotation speed of the first coupling member 12, that is, the rotation speed of the screw 11.

Further, the type of the installed toner cartridge 8 can be detected by pre-storing, in the ROM 101, the durations of the ON state detected by the switch main body 61 when various toner cartridges 8 are installed in the copier main body 1.

In the present embodiment, the first coupling member 12 is a flat cylindrical. However, the first coupling member 12 may be simply cylindrical or may not be flat. That is, the first coupling member 12 may take any shape as long as the push button 62 is pushed only when the protruding portion 18 lies opposite to the push button 62 and is otherwise not pushed.

Moreover, in the present embodiment, the protruding portion is provided only at the position corresponding to one of the projecting portions 17. However, protruding portions 18 may be provided at the positions corresponding to the respective projecting portions 17. In this case, the switch main body 61 detects the ON state twice during one rotation of the first coupling member 12. However, this does not pose any functional problems.

Further, in the present embodiment, the toner cartridge main body 8*a* is composed of the upper case 9*a* and the lower case 9*b*, which can be separated from each other in the vertical direction. However, the present invention is not limited to this. One longitudinal side surface of the toner cartridge main body 8*a* may be shaped like a cover.

The present invention is not limited to the as-described embodiment but may be embodied by varying the components of the embodiment without departing from the spirit of the present invention. Further, various inventions can be formed by appropriately combining a plurality of the components disclosed in the above embodiment. For example, some of the components shown in the embodiment may be omitted.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An image forming apparatus comprising a toner container and an image forming apparatus main body in which the toner container is installed, the toner container comprising:

a toner container main body having a predetermined length and which accommodates toner;

a mixer which stirs the toner in the toner container main body;

a discharge port through which the toner in the toner container main body is discharged from the toner container main body;

a screw having one end projected from one end surface of the toner container main body, the screw being rotated to convey the toner from the toner container main body to the discharge port;

a coupling portion provided at the one end of the screw and which rotates with the screw; and a protruding portion provided on an outer peripheral surface of the coupling portion, the image forming apparatus main body comprising: a driving portion which rotates the screw;

a pushed portion which is pushed by the protruding portion rotating with the screw;

a detecting portion which detects that the protruding portion is pushing the pushed portion; and a determining portion which determines the type of the toner container on the basis of the detection by the detecting portion.

2. The image forming apparatus according to claim 1, wherein the detecting portion detects a time for which the pushed portion has been pushed.

3. The image forming apparatus according to claim 2, wherein the toner container or the image forming apparatus main body further comprises a storage portion which stores the pushed time detected by the detecting portion.

4. The image forming apparatus according to claim 2, wherein the determining portion compares the pushed time with a preset predetermined time to determine the type of the toner container.

5. The image forming apparatus according to claim 1, wherein the determining portion calculates the amount of toner remaining in the toner container on the basis of the detection by the detecting portion.

6. The image forming apparatus according to claim 5, further comprising a display section which displays information on the toner remaining amount on the basis of the calculation of the toner remaining amount.

7. The image forming apparatus according to claim 1, wherein the detecting portion outputs an ON signal when the pushed portion is pushed.

8. The image forming apparatus according to claim 7, wherein the toner container or the image forming apparatus main body further comprises a storage portion which stores the number of times the ON signal has been output.

9. The image forming apparatus according to claim 7, wherein the determining portion calculates the toner remaining amount on the basis of the number of times the ON signals has been output.

10. The image forming apparatus according to claim 9, wherein the determining portion obtains information on the toner container on the basis of the number of times the ON signal was output during a predetermined time.

11. A toner container installed in an image forming apparatus, the toner container comprising:

a toner container main body having a predetermined length and which accommodates toner;

a mixer which stirs the toner in the toner container main body;

a discharge port through which the toner in the toner container main body is discharged from the toner container main body;

a screw having one end projected from one end surface of the toner container main body, the screw being rotated to convey the toner from the toner container main body to the discharge port;

a coupling portion provided at the one end of the screw and rotated by a driving portion provided in the image forming apparatus;

a protruding portion provided on an outer peripheral surface of the coupling portion and rotated to push a pushed portion provided in the image forming apparatus; and a storage portion which stores the number of times the pushed portion has been pushed.

12. A toner container installed in an image forming apparatus, the toner container comprising:

a toner container main body having a predetermined length which accommodates toner;

a mixer which stirs the toner in the toner container main body;

a discharge port through which the toner in the toner container main body is discharged from the toner container main body;

a screw having one end projected from one end surface of the toner container main body, the screw being configured to be rotated to convey the toner from the toner container main body to the discharge port;

a coupling portion provided at the one end of the screw, which has a cylindrical shape and an axis common to the screw;

a projecting portion provided at an end surface of the coupling portion opposite from the toner container main body and configured to engage with a driving portion of the image forming apparatus; and a protruding portion provided on an outer peripheral surface of the coupling portion which closes towards the axis as a distance from the toner container main body increases.

13. The toner container according to claim 12, wherein the screw is rotated by the driving portion by engaging the projection portion of the coupling portion with the driving portion.

14. The toner container according to claim 12, wherein the projecting portion has an outer surface which has an axis in common to the coupling portion, and the outer surface is inclined so that it approaches the axis of the coupling portion as the distance from the toner container main body increases.

15. The toner container according to claim 14, wherein the angle of inclination of the outer surface of the projecting portion to the axis of the coupling portion is 5° to 30°.

16. The toner container according to claim 14, wherein the protruding portion is provided at a position corresponding to the projecting portion.

17. The toner container according to claim 14, wherein the protruding portion has an outer surface located radially outside the coupling portion exterior to the outer peripheral surface of the coupling portion, the outer surface includes a pushing surface and an installing connecting surface, the pushing surface pushes a push switch for detecting the coupling portion, and the installing connecting surface connects the pushing surface and the outer surface of the projecting portion together.

18. The toner container according to claim 17, wherein the installing connecting surface inclines along the outer surface of the projecting portion.

19. The toner container according to claim 17, wherein the protruding portion has a pushing connecting surface connecting the pushing surface of the protruding portion and the outer peripheral surface of the coupling portion together, and the pushing connecting surface leads a push button of the push switch to the pushing surface.

20. The toner container according to claim 12, wherein the coupling portion has another projection portion on the end surface, and the another projection portion and the projection portion are facing the radial direction of the coupling portion.

21. A toner container installed in an image forming apparatus, the toner container comprising:

toner accommodating means for accommodating toner, the toner accommodating means having a discharge port to discharge toner;

stirring means for stirring the toner in the toner accommodating means;

conveying means having one end projected from one end of the toner accommodating means, the conveying means being configured to be rotated to convey the toner from the toner accommodating means to the discharge port;

coupling means provided at the one end of the conveying means, which has a cylindrical shape and an axis common to the conveying means;

a projecting portion provided at an end of the coupling means opposite from the toner accommodating means and configured to engage with driving means of the image forming apparatus;

a protruding portion provided on an outer peripheral portion of the coupling means which closes towards the axis as a distance from the toner accommodating means increases.

* * * * *